US005850729A

United States Patent [19]

Irmen

[11] Patent Number: 5,850,729

[45] Date of Patent: Dec. 22, 1998

[54] APPARATUS FOR DETACHING THE TERMINAL SPIRAL WINDINGS FROM THE SURFACE OF A SPINNING COP

[75] Inventor: Wolfgang Irmen, Mönchengladbach, Germany

[73] Assignee: W. Schlafhorst AG & Co., Moenchengladbach, Germany

[21] Appl. No.: 881,137

[22] Filed: Jun. 24, 1997

[30] Foreign Application Priority Data

Jun. 24, 1996 [DE] Germany ..... 196 25 090.0

[51] Int. Cl.[6] ..... D01M 9/00

[52] U.S. Cl. ..... 57/278; 57/261; 242/562

[58] Field of Search ..... 242/35.6 E, 562, 242/35.5 R, 35.5 A; 57/261, 262, 263, 278

[56] References Cited

U.S. PATENT DOCUMENTS

| | | | |
|---|---|---|---|
| 2,675,971 | 4/1954 | Abbott et al. | 242/35.6 |
| 4,150,532 | 4/1979 | Ligones | 57/263 |
| 4,295,330 | 10/1981 | Pfeifer | 57/263 |
| 4,896,841 | 1/1990 | Topuett | 242/35.6 E |
| 5,037,036 | 8/1991 | Okuyama | 242/35.6 E |
| 5,056,725 | 10/1991 | Wirtz et al. | 242/35.6 E |
| 5,083,715 | 1/1992 | Wirtz et al. | 242/35.6 E |
| 5,310,126 | 5/1994 | Hensen et al. | 242/35.6 E |
| 5,586,428 | 12/1996 | Asai et al. | 57/278 |

FOREIGN PATENT DOCUMENTS

| | | |
|---|---|---|
| 0 327 993 A1 | 2/1989 | European Pat. Off. . |
| 0 412 344 A2 | 7/1990 | European Pat. Off. . |
| 1 560 427 | 11/1969 | Germany . |
| 38 04 373 A1 | 8/1989 | Germany . |
| 39 18 788 A1 | 12/1989 | Germany . |
| 41 10 626 A1 | 10/1992 | Germany . |
| 1 209 031 | 1/1996 | Germany . |

*Primary Examiner*—William Stryjewski
*Attorney, Agent, or Firm*—Kennedy Covington Lobdell & Hickman, LLP

[57] ABSTRACT

An apparatus for detaching the terminal spiral winding of yarn from the surface of a spinning cop, utilizes a hook-like yarn catcher element movable vertically along the cop by a pulling device and movable into and out of engagement with the yarn surface of the cop by a spring-loaded guide linkage to which the catcher element is mounted. The guide linkage has two levers pivoted at two respective pivot locations on a base plate and pivotably connected at two spaced pivot locations with the catcher element for coordinated movement to control extension and retraction of the catcher element, the distance between the pivot locations on the base plate being greater than the distance between the pivot locations connected with the catcher element for pivoting the catcher element with an increasing angle of inclination relative to the lengthwise extent of the cop during extension of the catcher element.

13 Claims, 3 Drawing Sheets

APPARATUS FOR DETACHING THE TERMINAL SPIRAL WINDINGS FROM THE SURFACE OF A SPINNING COP

FIELD OF THE INVENTION

The present invention relates to a device for detaching the terminal spiral from the surface of a spinning cop and, more particularly, to a novel device of such type which is arranged to rotate opposite the winding direction during the detachment process and has a yarn detaching means which can be placed under a spring force against the cop surface of the spinning cop.

BACKGROUND OF THE INVENTION

Terminal spiral yarn windings on a spinning cop are the result of the normal functioning of textile spinning machines which produce the spinning cops. Specifically, with ring spinning machines it is customary at the completion of a cop spinning operation, during the so-called spinning end, to displace the ring rail out of its upper position rapidly into a lowered position in order to apply so-called underwindings to the wharves of the spindles. These underwindings are necessary in order to be able to start a new spinning operation automatically on the ring spinning machines after the completed spinning cops have been doffed. In the course of the downward movement of the ring rail a few yarn windings, which are hereinafter generally identified as terminal spiral surface windings, are placed on the surface of the still rotating spinning cops.

Such terminal spiral windings rest relatively firmly on the cop surface and have some advantages during the transport of the cops from the spinning machine to the bobbin winding machine since, for example, the danger of the yarn end becoming snagged on a foreign object and thereby loosened to form dragging yarn, is reduced.

However, a terminal spiral winding firmly attached to the cop surface is a nuisance at the winding heads of an automatic cheese winder, since often it is not possible in the winding head area to pneumatically detach the terminal spiral winding and thus the yarn end of the spinning cop. However, the splicing of the freshly supplied spinning cop to a cheese held in the winding frame of the respective winding head, and therefore the continuation of the rewinding process, is not possible without detaching the leading yarn end from the cop.

It has therefore been shown to be useful to transport the spinning cops through so-called cop preparation stations on their way to the winding heads, where the terminal spiral windings of the spinning cops are detached and the yarn end of each cop is made ready for the subsequent rewinding process, for example in the form of a top winding on the upper end of the cop.

Cop preparation devices of this type, with yarn detaching means for detaching the terminal spiral adhering to the cop surface, are known in various embodiments. However, the known cop preparation devices have not been always completely satisfactory in actual use, in particular under more difficult conditions.

For example, a device is disclosed and a method is described in U.S. Pat. No. 2,675,971, which is intended to assure the correct preparation of spinning cops. With this known method, the terminal spiral winding is first detached by means of a hook formed by a bent wire, prior to picking up the beginning of the yarn by means of a suction slit disposed along a suction tube. This hook is seated in a hinge and, among other things, is also displaced by the yarn pull of the grasped yarn parallel with the longitudinal cop axis, by means of which the entry of the hook into the yarn layers is intended to be prevented. In the process, the hook is in engagement with the cop surface until the cop has been moved by a defined distance along the transport line. If the hook grasps the reserve yarn immediately after having come into contact with the cop surface, it pulls the portion of the yarn extending in the direction toward the cop tip firmly on the surface of the cop windings. Thus, there is a danger that, because of the downward deflection of the hook, the grasped yarn tears relatively late, so that additional, relatively flat and very strong windings are applied on the cop surface. In this case the grasping of the yarn by succeeding devices is made considerably more difficult.

German Patent Publication DE 15 60 427 A1 discloses a cop preparation station with two yarn detachment elements which are arranged orthogonally displaceable in relation to the cop surface. On their ends the yarn detachment elements respectively have a stop matched to the cop diameter and a yarn catcher hook. The yarn detaching elements, which are displaceably seated on linear guides, are maintained in contact with the cop surface by spring elements and can be mechanically retracted.

Further devices for detaching the terminal spiral winding from the surface of spinning cops are described in European Patent Publications EP 0 327 993 A1 and EP 0 412 344 A1.

In the arrangement in accordance with EP 0 327 993 A1, a spinning cop is rotated around its longitudinal axis. In the course of such rotation, a catcher hook, embodied in the manner of an embroidery needle and having a rear-oriented rounded tip, is placed against the cop such that the rearward facing tip of the catcher hook points opposite the direction of rotation of the cop and thereby comes into contact with the cop surface until the catcher hook has caught the terminal spiral winding. The catcher hook is thereafter retracted tangentially from the spinning cop, while the terminal spiral winding remains hooked until it either tears or the yarn end has been detached from the cop. The retraction of the catcher hook is preferably performed by means of a pneumatic cylinder.

The arrangement known from EP 0 412 344 A1 has a yarn detacher embodied as a searching knife, to which an electronic sensor for controlling the capture of the yarn is assigned. A timer is also provided, in which a maximum search time is stored. Direct command signals can be generated by the sensor if the yarn has been detected within the maximum search time. A search guide is associated with the searching knife. A front portion of the searching knife is shaped in the form of a wedge, and a back portion of the searching knife is arched such that the grasped yarn sliding up on it is lifted off the yarn surface sufficiently so that it can be detected by the sensor.

OBJECT AND SUMMARY OF THE INVENTION

Based on the above described prior art, it is a fundamental object of the present invention to improve the known devices for detaching the terminal spiral winding from the surface of a spinning cop.

Briefly summarized, the present invention accomplishes this object by providing an apparatus basically operative for detaching a terminal spiral winding of yarn from the yarn surface of a textile yarn spinning cop while rotating the cop opposite the winding direction of the yarn thereon. According to the present invention, the apparatus essentially has a yarn detaching arrangement and means for moving the yarn detaching arrangement lengthwise along the cop, the yarn detaching arrangement having a yarn detacher element for acting on the reserve yarn winding on the cop and a guide linkage for selectively extending and retracting the yarn detacher element into and out of proximity with the yarn surface of the cop during movement along the cop.

This arrangement of the yarn detacher in accordance with the invention has the particular advantage that the reserve yarn winding is graspable over the entire area of the surface of the spinning cop during the lengthwise movement of the yarn detacher, so that the yarn end is detached carefully and gently from the cop surface.

In a preferred embodiment, the guide linkage comprises a pivot arrangement for pivoting the detacher element with an increasing angle of inclination of the detacher element relative to the lengthwise extent of the cop during extension of the detacher element. More specifically, the guide linkage has two levers pivoted at two respective pivot locations on a base plate and pivotably connected at two spaced pivot locations with the detacher element for coordinated movement to control extension and retraction of the detacher element, the distance between the pivot locations on the base plate being greater than the distance between the pivot locations connected with the detacher element. The yarn detaching arrangement is preferably moved by a pulling means extending along the lengthwise extent of the spinning cop and connected to the guide linkage.

This embodiment assures that the yarn detaching arrangement remains in proximity with the surface of the spinning cop over the entire length of the spinning cop to be processed. Thus, the terminal spiral winding yarn will optimally be grasped along the upper area of the spinning cop and subsequently will be carefully detached over the entire length of the cop.

Because the angle of inclination of the yarn detaching arrangement changes as the detacher element is pivoted outwardly, it is assured even in an area along which the yarn surface of the cop is not linear, e.g., at an area of a waist-like taper of the cop, that the yarn detaching arrangement remains in steady contact with the cop surface and therefore the terminal spiral winding yarn is dependably detached in these areas, particularly in connection with problem or so-called crippled cops.

One contemplated means for moving the yarn detaching arrangement utilizes a reversible drive connected with the pulling means via a deflection roller. This form of a drive device is basically known in principle and proven.

Preferably, the guide linkage comprises a spring element for biasing one of the levers of the linkage arrangement to urge extension of the detacher element into proximity with the yarn surface of the cop. An arresting device may be provided for adjusting the spring force of the spring element. A piston element is provided for acting on the other lever for retracting the detacher element from proximity with the yarn surface of the cop.

Thus, the guide linkage provides a comparatively simple and rugged structure, which can operate to the greatest extent without problems, even under difficult environmental conditions, such as are known to exist frequently in spinning mills, so that, on the one hand, the guide linkage permits a perfect and sensitive displacement of the yarn detacher along the surface of the spinning cop and, on the other hand, assures the dependable retraction of the yarn detaching arrangement.

Spring biasing of the linkage arrangement provides the further advantage that the detacher element is always maintained in contact with the surface of the spinning cop under a slight pressure during the course of the detaching process, whereby irregularities of the cop surface, such as occur particularly with crippled cops, are automatically compensated by the pivoting of the detacher element.

The arresting device permits the exact setting of the contact pressure of the catcher element and also makes it possible to adjust the terminal spiral winding detaching arrangement specially to the respective spinning cop batch, i.e. to adapt it to changed yarn parameters.

The use of a piston-and cylinder assembly to retract the guide linkage insures that, with the piston retracted, the outward pivot path of the guide linkage is not hampered, but the extension of the piston enables an instantaneous retraction of the detacher element.

As indicated, the detacher element is preferably configured to engage the terminal spiral winding yarn, e.g., as a hook-like yarn catcher element configured to be inserted between the yarn surface of the cop and the terminal spiral winding yarn. The embodiment of the detacher element in the form of a hook-shaped catcher element in particular has been shown to be advantageous, because on the one hand such a device is gentle on the yarn, and on the other hand it operates very dependably.

It is further preferred that the yarn detaching arrangement include a centering element for retaining the spinning cop during the detachment of the terminal spiral winding. In particular, the centering element has a centering head movable with the yarn detaching arrangement between a working position engaging the spinning cop and an idle position out of engagement with the cop. This cop centering arrangement has the advantage that the spinning cop to be prepared is maintained in a defined work position, without the centering means being required to have to have its own drive for moving between the idle and operating positions.

Further details of the invention will be understood from an exemplary embodiment represented by means of the drawings.

DETAILED DESCRIPTION OF THE PREFERRED EMBODIMENT

Figure 1:
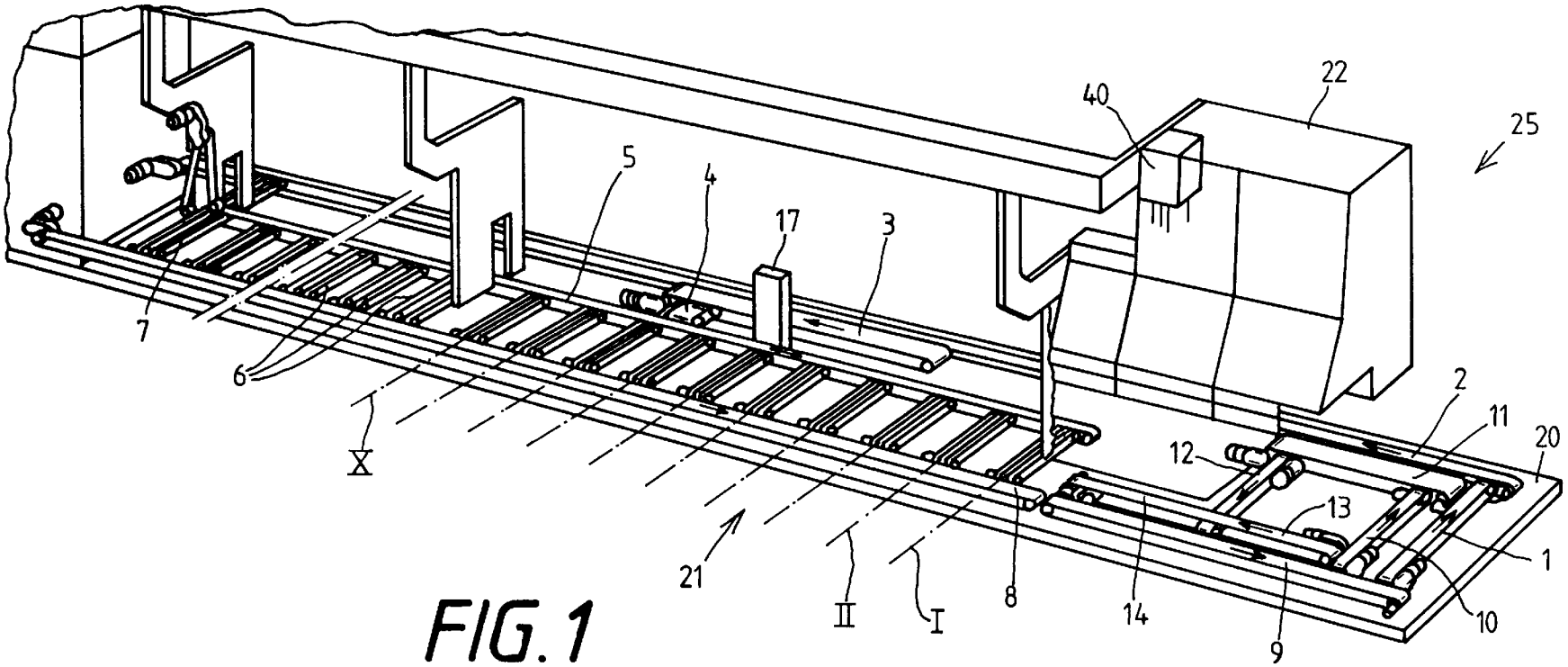
FIG. 1 is a top perspective view of a bobbin carrier transport system associated with a bobbin winding machine, only schematically indicated, and equipped with a terminal spiral winding detachment device according to the present invention.

Referring now to the accompanying drawings and initially to FIG. 1, a typical bobbin carrier transport system 21 for a bobbin winding machine 25, only schematically indicated for reasons of clarity, is represented in a perspective top view. In this case, the representation of the bobbin winding machine 25 is essentially limited to the power and operating unit 22, disposed on one end of the machine, in which the central control unit 40 is housed. The winding machine 25 has a plurality of winding stations (commonly referred to as winding heads) aligned side-by-side along the length of the machine, but the winding heads have not been depicted except by way of an indication of the positional locations of the winding heads at I, II, . . . , X, etc., in order not to obscure the transport system 21 which functions to deliver spinning cops to the winding heads for rewinding into larger yarn cheeses.

The bobbin carrier transport system 21 is disposed on a chassis identified as a whole by 20. The transport system 21 has a plurality of different transport lines, in which bobbin carriers revolve, driven by endless transport means and guided in guide contours (not represented). Typically, the bobbin carriers are in the form of pallets or trays having a flat base which can be supported for movement on the transport lines and an upstanding peg or pin adapted to mount an individual cop in upstanding disposition.

The various transport lines function as follows. The transfer line 1 constitutes the interface of the instant transport system 21 with the transport systems of textile machines placed upstream in the production process. As a rule, these upstream located textile machines are ring spinning machines.

The transfer of the spinning cops produced on the ring spinning machines from the transport system of the ring spinning machines to the transport system of the bobbin winding machines, as well as the return of the depleted tubes after rewinding takes place in the area of the transfer line 1 by means of a known transfer device (not shown). The spinning cops are supported on bobbin carriers as a result of the normal operation of the bobbin spinning machine. The bobbin carriers and their supported cops are transported by the transfer line onto a transport line 2 which extends the length of the machine to deliver the carriers and cops to one or more parallel cop preparation lines such as the line 3, at which a preparation station 17 is provided to detach the terminal spiral winding from the surface of each spinning cops, among other things, and to form the detached yarn end into a nose winding on each cop. Subsequently, the thusly prepared cops are transferred with their carriers onto a cop supply line 5 via a perpendicular removal line 4 extending from the preparation line 3 to the supply line 5, which serves as a cop storage means. A plurality of cop transport lines 6 extend transversely from the cop supply line 5 at spacings therealong to the respective winding heads I, II, etc. The cop supply line 5 is alternatingly switched from left to right movement to insure that the carrier-mounted cops on the supply line 5 are distributed among the plural transport lines 6. As a rule, each of the transverse transport lines 6 can support up to three carrier-mounted cops, with one cop in an unwinding position at the associated winding head, while two further cops, also positioned on bobbin carriers, are parked in reserve or waiting positions in front of the unwinding position.

After unwinding of a cop at a winding head, the empty tube (still mounted on its associated carrier) is transported by the respective transport line 6 onto a perpendicular return line 8 extending along the length of the machine and then onto a distributing line 9 to return to the transfer line 1, from which the empty cops and carriers are returned by means of the transfer device to the transport system of the ring spinning machine.

Cops which could not be processed by the preparation device(s) 17 arranged in the area of the preparation line(s) 3 are transported to the opposite end of the winding machine at which such cops and their carriers are transferred onto a connecting line 7 and therefrom directly to the return line 8 and then the distributing line 9. The distribution line 9 guides carriers with cop tubes with a small remaining amount of yarn and full cops which were not prepared to a transfer line 10, from which the tubes or cops are distributed, depending on the state of the yarn thereon, to a tube cleaning line 13 or to another preparation line 11 to deliver them onto a repetition line 12 along which a special preparation station is disposed. Cops whose terminal spiral winding can not be prepared even by the special preparation station along the repetition line 12, are delivered to a manual preparation line 14.

Figure 2:
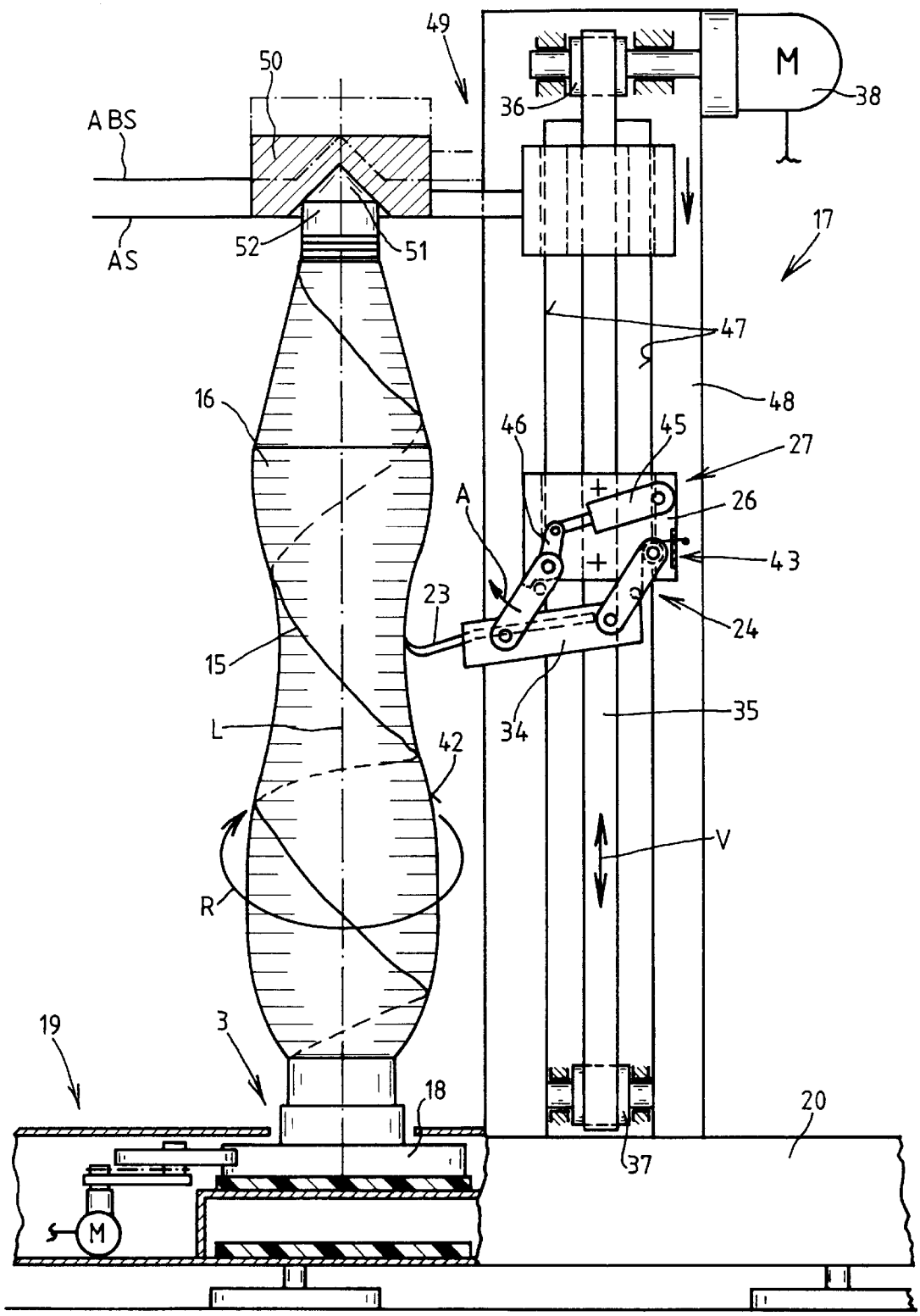
FIG. 2 is a side elevational view of the terminal spiral winding detachment device of the present invention in the course of preparing a spinning cop.

Referring now to FIG. 2, a cop preparation station with a terminal spiral winding detachment device in accordance with the present invention is shown which is suitable for use as the preparation station 17. A spinning cop 16, shown as a crippled cop for purposes of illustration, is shown in position at the front of the preparation station 17. As is customary as indicated above, the spinning cop 16 is standing upright on a bobbin transport pallet 18. The bobbin transport pallet 18, and thus the associated spinning cop 16, have been routed via the transfer line 1 and the transport line 2 to the preparation line 3, along which the pallet 18 is stopped in position in the area of the preparation station 17 by a positioning device 19.

The preparation station 17 has a yarn detachment means equipped with a hook-like catcher element 23 having its hooked end curved upwardly, and the catcher element 23 is connected via a guide linkage 24 with the base plate 26 of a yarn detacher, indicated as a whole by 27. As can best be seen in FIG. 3, the guide linkage 24 includes a pair of spaced levers 32 and 33 pivoted to the base plate 26 and supporting a bearing element 34 via an arrangement of hinge shafts 28, 29, 30, 31, with the hook-like catcher element 23 fastened on the bearing element 34. The hinge shafts 28, 29, 30, 31 are selectively arranged such that the distance between the hinge shafts 28, 29 connected to the base plate 26 is greater than the distance between the hinge shafts 30, 31 which connect the levers 32 and 33 with the bearing element 34.

A spring element 41 is mounted to the base plate 26 at one end and engages a detent 39 on the lever 33 to urge the guide linkage 24 and thus the catcher element 23 to pivot outwardly in the direction A toward the cop surface. An arresting device 43 is provided on the base plate 26 to engage the spring element 41 to enable its spring force to be delicately set.

Figure 3:
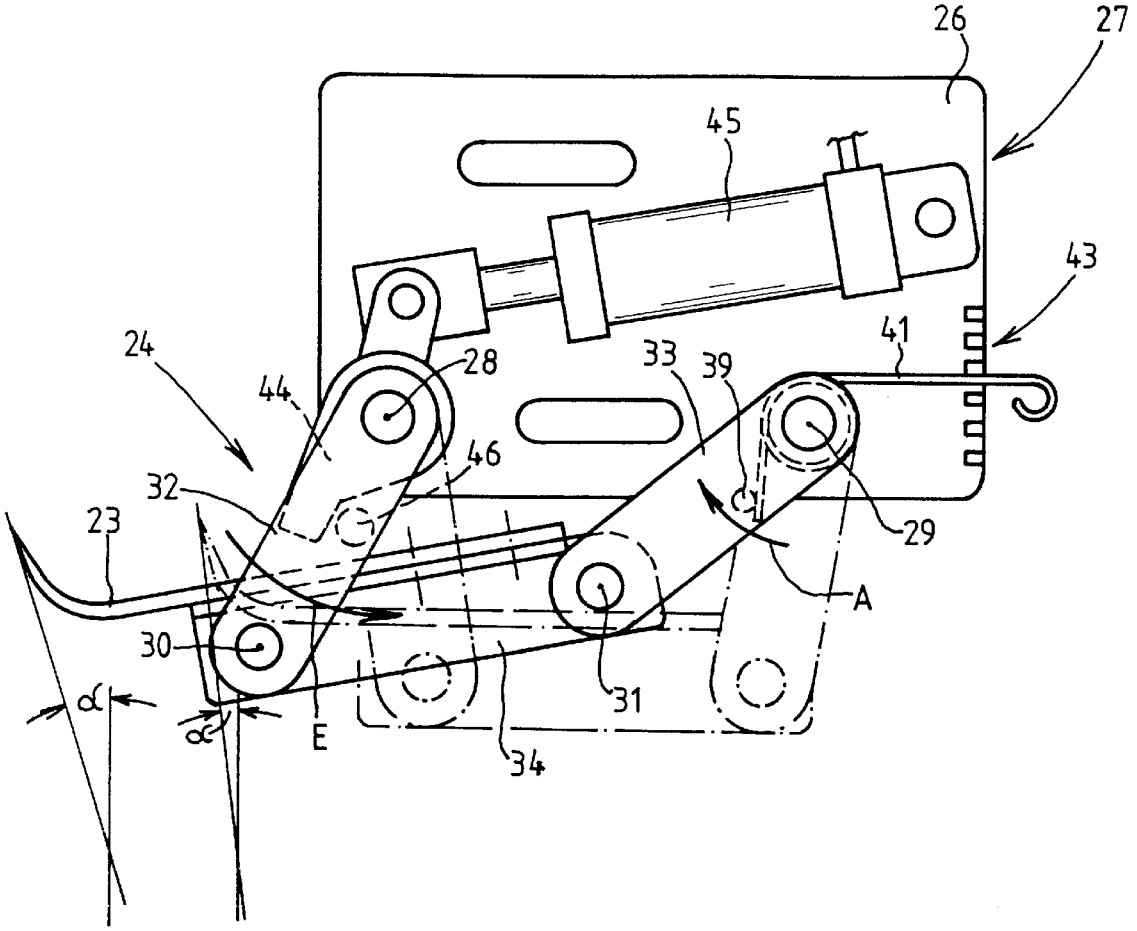
FIG. 3 is an enlarged elevational view of the yarn detacher mechanism of the terminal spiral winding detachment device.

A return lever 44 is rotatably seated on the base plate 26 in the area of the hinge shaft 28 and is connected with the projecting piston of a piston-and-cylinder assembly 45. When the piston of the piston-and-cylinder assembly 45 is extended, the return lever 44 acts on a detent 46 arranged on the lever 32 to cause the yarn catcher element 23 to pivot rearwardly (arrow E) into its initial position. As indicated in FIG. 3, the angle of inclination $\partial$ of the catcher element 23 increases when the guide linkage 24 is pivoted outwardly in the direction A.

The base plate 26 of the yarn detacher 27 is movable vertically along guides 47 on the chassis 48 of the preparation station 17 and can be displaced in the vertical direction V by means of a belt or other pulling means 35 trained over deflection rollers 36, 37 at the upper and lower ends of the chassis 48 and driven by connection of the upper deflection roller 36 with a reversible drive 38.

A centering means 49 is also displaceably seated on the guide 47. The centering means 49 has a centering head 50 having a conically-shaped receiving recess 51. In the operating position AS, the centering head 50 has been lowered from above onto the tube tip 52 of the spinning cop 16, so that the spinning cop 16 which is to be prepared is securely held fixedly at the front of the terminal spiral winding detachment device.

Operation of the terminal spiral winding detachment device may thus be understood. Initially, a spinning cop 16 previously produced on a ring spinning machine, and therefore having a terminal spiral winding 15, is conveyed in upstanding disposition on a bobbin transport pallet 18 along the preparation line 3 into the area of the preparation device 17 equipped with the yarn detacher 27, initially disposed in an idle position, i.e., with the centering device 49 raised into its upper position ABS and with the yarn detacher 27 similarly raised and the catcher element 23 retracted. In this position, the centering means 49 is elevated sufficiently that the spinning cop 16 can be moved into a working position underneath the centering head 50. When the spinning cop 16 mounted on the bobbin transport pallet 19 reaches the preparation device 17, the cop and pallet unit is stopped in a predetermined work position by the positioning device 19. Subsequently, the centering device 49 and the yarn detacher 27 are lowered and the spinning cop 16 is slowly rotated by the drivable positioning means 19 in a direction R opposite to the winding direction of the yarn on the cop.

In the course of lowering the centering means 49 and the yarn detacher 27, the centering head 50 of the centering means 49 is placed with its cone-shaped receiver 51 over the tube tip 52 of the spinning cop 16. At the start of the lowering of the yarn detacher 37, the piston of the piston-and-cylinder assembly 45 is also extended inwardly, so that the hook-like catcher element 23 of the yarn detacher 27 is pivoted outwardly in the direction A toward the cop surface 42 under the biasing effect of the spring element 41. In the process, the tip of the catcher element 23 is gently placed against the cop surface 42 of the spinning cop 16. In the course of continuing downward movement of the yarn detacher 27, the tip of the catcher element 23 continuously remains on the surface 42 of the spinning cop 16, so that the contour of the spinning cop is exactly followed, even with abnormally shaped cops such as the defective cop shown for exemplary purposes in FIG. 2.

Because of the rotation of the spinning cop 16 in the counter-winding direction R, the terminal spiral winding of yarn 15 slides automatically over the catcher element 23 and is dependably and gently detached from the cop surface by the downward gliding yarn detacher 27.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. Apparatus for detaching a terminal spiral winding of yarn from the yarn surface of a textile yarn spinning cop while rotating the cop opposite the winding direction of the yarn thereon, the apparatus having a yarn detaching arrangement and means for moving the yarn detaching arrangement lengthwise along the cop, the yarn detaching arrangement having a yarn detacher element for acting on the reserve yarn winding on the cop and a guide linkage for selectively articulating the yarn detacher element toward and away from the yarn surface of the cop, the guide linkage including means for maintaining the yarn detacher element in proximate following relation to the yarn surface of the cop during movement along the cop.

2. The apparatus in accordance with claim 1, wherein the guide linkage comprises a pivot arrangement for pivoting the detacher element relative to the lengthwise extent of the cop during extension of the detacher element.

3. The apparatus in accordance with claim 2, wherein the guide linkage has two levers pivoted at two respective pivot locations on a base plate and pivotably connected at two spaced pivot locations with the detacher element for coordinated movement to control extension and retraction of the detacher element, the distance between the pivot locations on the base plate being greater than the distance between the pivot locations connected with the detacher element.

4. The apparatus in accordance with claim 1, wherein the means for moving the yarn detaching arrangement comprises a pulling means extending along the lengthwise extent of the spinning cop and connected to the guide linkage.

5. The apparatus in accordance with claim 4, wherein the means for moving the yarn detaching arrangement comprises a reversible drive connected with the pulling means via a deflection roller.

6. The apparatus in accordance with claim 1, wherein the guide linkage comprises at least one lever and a spring element biasing the lever to urge extension of the detacher element into proximity with the yarn surface of the cop.

7. The apparatus in accordance with claim 6, wherein the guide linkage comprises an arresting device for adjusting the spring force of the spring element.

8. The apparatus in accordance with claim 1, wherein the guide linkage comprises at least one lever and a piston element acting on the lever for retracting the detacher element from proximity with the yarn surface of the cop.

9. The apparatus in accordance with claim 1, wherein the detacher element is configured to engage the terminal spiral winding yarn.

10. The apparatus in accordance with claim 9, wherein the detacher element is configured to be inserted between the yarn surface of the cop and the terminal spiral winding yarn.

11. The apparatus in accordance with claim 10, wherein the detacher element comprises a hook-like yarn catcher element.

12. The apparatus in accordance with claim 1, wherein the yarn detaching arrangement comprises a centering element for retaining the spinning cop during the detachment of the terminal spiral winding.

13. The apparatus in accordance with claim 12, wherein the centering element has a centering head movable between a working position engaging the spinning cop and an idle position out of engagement with the cop.

* * * * *